US005988710A

United States Patent [19]

Kortschot et al.

[11] Patent Number: 5,988,710

[45] Date of Patent: Nov. 23, 1999

[54] VARIABLE LENGTH SECURITY BAR

[75] Inventors: Cornelis Kortschot, Cambridge; Mark T. Kortschot, Unionville; Wesley G. Whitford, Acton, all of Canada

[73] Assignee: Defendoor Security Limited, Ontario, Canada

[21] Appl. No.: 09/027,743

[22] Filed: Feb. 23, 1998

Related U.S. Application Data

[63] Continuation-in-part of application No. 08/708,726, Sep. 5, 1996, abandoned.

[60] Provisional application No. 60/003,236, Sep. 5, 1995.

[51] Int. Cl.[6] ..... E05C 17/44

[52] U.S. Cl. ..... 292/339; 292/272

[58] Field of Search ..... 292/338, 339, 292/295, 273, 272

[56] References Cited

U.S. PATENT DOCUMENTS

| | | |
|---|---|---|
| 598,405 | 2/1898 | Williams . |
| 2,870,281 | 1/1959 | Mitchell . |
| 3,124,382 | 3/1964 | Strother . |
| 4,019,765 | 4/1977 | Nichola . |
| 4,157,128 | 6/1979 | Peters . |
| 4,563,027 | 1/1986 | Chechovsky et al. . |
| 4,607,253 | 8/1986 | Wooten et al. . |
| 4,607,870 | 8/1986 | Crisp, Jr. et al. . |
| 4,673,203 | 6/1987 | Chezem . |
| 4,858,972 | 8/1989 | Salyer . |
| 4,971,374 | 11/1990 | Lovell et al. . |
| 5,040,835 | 8/1991 | Barker . |
| 5,064,232 | 11/1991 | Quarberg . |
| 5,135,273 | 8/1992 | MacCalder . |
| 5,340,175 | 8/1994 | Wood . |
| 5,787,548 | 8/1998 | Tzen ..... 16/82 |

FOREIGN PATENT DOCUMENTS

| | | |
|---|---|---|
| 1017770 | 9/1977 | Canada . |
| 1019016 | 10/1977 | Canada . |
| 1042946 | 11/1978 | Canada . |
| 2068819 | 11/1992 | Canada . |
| 2188676 | 10/1987 | United Kingdom . |
| 2193247 | 2/1988 | United Kingdom . |

*Primary Examiner*—Steven Meyers
*Assistant Examiner*—Gary Estremsky
*Attorney, Agent, or Firm*—R. Craig Armstrong

[57] ABSTRACT

This security bar for positioning between a door and the floor has telescopic sections which permit the door to be opened a small distance, corresponding to the degree of telescoping which is permitted, so as to permit a clear gap between the door and its frame, if desired. The sections telescope by virtue of a bolt positioned through holes in one of the sections and a slot in the other section, the length of the slot determining the maximum possible telescoping. A pin can be positioned through additional holes in the first section and through the slot, to restrict the degree of telescoping which is permitted, from the maximum telescoping down to essentially no telescoping at all. The overall length of the bar preferably is adjustable as well.

16 Claims, 4 Drawing Sheets

VARIABLE LENGTH SECURITY BAR

REFERENCE TO RELATED APPLICATIONS

This application is a continuation-in-part of application Ser. No. 08/708,726 filed Sep. 5, 1996, now abandoned, which was a formal application based on and claiming the benefit of provisional application No. 60/003,236, filed Sep. 5, 1995.

BACKGROUND OF THE INVENTION

This invention relates to a security bar to prevent or restrict the opening of a door.

Entrance to a dwelling is normally controlled by a hinged door that is equipped with locks such as mortice locks, dead bolts and the like, in order to prevent entrance. Sliding bolts at the side, top or bottom of the door can be installed to provide further security against unauthorized entry.

While the installation of locks can adequately prevent the door from being opened, it is desirable on many occasions to open the door a few inches to create a clear gap between the door and the door frame, in order to be able to address the person outside, i.e. to speak to them "face to face". It may be necessary to pass a document that needs a signature, to inspect credentials or simply to receive an envelope or paper. It is also not considered good manners to talk through a closed door. There is therefore a need for a device that allows the door to be opened a distance that provides a clear gap between the door and the door frame, after the locks are disengaged. There of course is also a need for a device which supplements the ordinary door locks when the door is closed and locked.

The most commonly used device that allows the door to be opened a small distance and still provide a degree of protection against unauthorized entry, is the well-known door chain. This chain is fastened to both the door and the door frame on the inside of the door. The chain can be unfastened by sliding it to the end of the slotted fitting. The chain is positioned in such a way that it can only be unfastened when the door is closed. With the chain in place the door can be opened a few inches but it remains secured.

The problem with these chains is that unless the chain is an unusual heavy gauge and even more important, unless the chain is fastened with very strong (long screws, it can be dislodged or broken fairly easily by applying force to the door. The chains that are commonly sold in hardware stores in North America are not very strong and the screws that secure the ends of the chain or its fittings to the door and to the door jamb are typically ¾ inch long and not very strong. When the door is partly opened, it is also fairly easy to cut the chain from the outside with bolt cutters or break it by hitting it with a steel bar. Chains are therefore only effective if the person on the outside is willing to respect the imposed restriction of entry.

Another common device that is now often used provides more protection than a door chain. These are security brackets that consist of an elongated loop made of ⅛×inch steel that is fastened with a hinge to the door frame. A curved pin with a thicker, spherical end is fastened with screws to the inside of the door. When the door is in the closed position, the hinged loop can engage the curved pin. When the door is opened, the round end of the pin moves to the end of the loop and the length of the loop is the distance that the door can be opened. Although this bracket provides more protection than a door chain, it is exposed to the intruder when the door is opened and the bracket can be jimmied quite easily because it is only fastened to the door frame with two screws.

If the person on the outside has criminal intentions and wants to disregard the restriction to entry, a phenomenon that is now known as "home invasion", the door chain or security bracket provides little or no real protection. There have been a number of incidents where the door was forced open with criminal intent, resulting in robberies and often injuries to the occupants.

One device that provides additional security and keeps a door closed even in the event that the locks are disengaged, is a bar that is positioned at an angle of about 60 degrees to the horizontal plane, between the door and the floor. When an attempt is made to forcibly open the door, this bar or brace will transfer a portion of the force exerted on the door to the floor and prevent opening of the door. These security bars are effective because they cannot be removed or broken by jimmying the door and they are effective when the locks are picked or opened with pass keys.

In a typical version, these bars have a foot that is equipped with a skid-resistant rubber pad which is effective because the typical 60 degree angle of the bar directs a portion of the force that is exerted on the door in a vertical direction downwards, and provides a strong force that presses the foot against the floor thereby preventing skidding of the foot that would result in making the bar ineffective. Many bars are equipped, at the top end that touches the door, with a Y-shaped section that fits under the doorknob.

While these various versions of security bars are effective in keeping the door in the closed position, one common deficiency of most of these devices is that the bar needs to be removed completely before the door can be opened. The door cannot be opened, even a small distance, in order to address the caller face to face. The protection that is provided by the security bar is then lost and the occupant again depends on a door chain, if they are installed, to prevent the door from being opened farther.

SUMMARY OF THE INVENTION

In the invention, the security bar is designed to allow the door to be opened for a short distance, so that there is a clear gap between the door and the door frame of two or three inches, without removing the bar from its angled position that forms a brace to prevent the complete opening of the door. This is achieved by the use of a bar that has a variable length that allows the bar to be compressed for a distance of between zero and four inches, for example, depending on an adjustable setting. A spring-loaded section of the bar is compressed when the door is opened until, at a predetermined distance, the upper end of the sliding slot meets a pin, preferably of steel, that prevents further compression, thereby preventing the door from opening farther. Preferably, the distance by which the bar is compressed and therefore the distance that the door can be opened, is adjustable by means of a pin that contacts the lower end of the slots and determines the total length of the bar before compression. In the preferred embodiment of the invention, the bar is adjustable so that it can be compressed for a distance of zero to four inches. When the bar is placed at an angle of 60 degrees to the floor, this means that the door can be opened for a distance of approximately zero to eight inches depending on the adjustable setting.

Further features of the invention will be described or will become apparent in the course of the following detailed description.

BRIEF DESCRIPTION OF THE DRAWINGS

The invention will now be described in greater detail, with reference to the accompanying drawings of the preferred embodiment by way of example only, in which.

DETAILED DESCRIPTION OF THE PREFERRED EMBODIMENT

Figure 1:
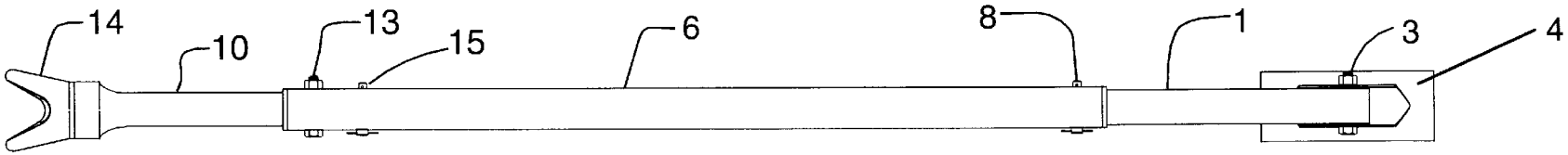
FIG. 1 is a top view of the device.
Figure 2:
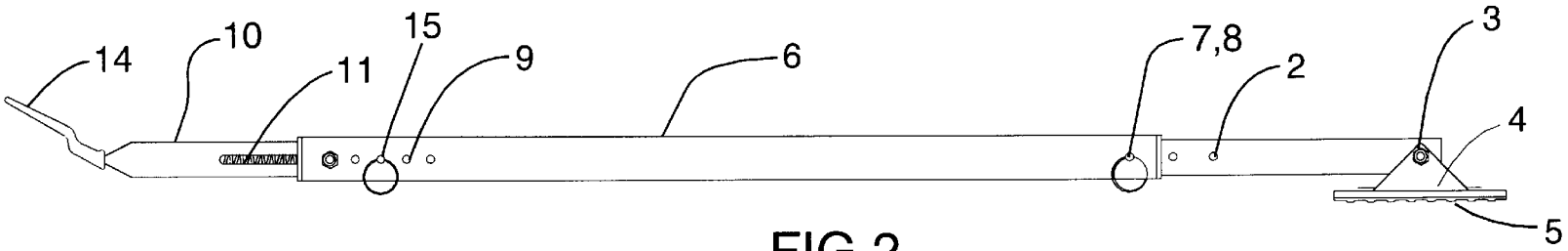
FIG. 2 is a side view of the device.

In the preferred version of the invention, the security bar has three sections. The bottom section 1 is made from tubular steel (or any other suitably strong material) equipped with a number of opposing holes 2, that is attached by a hinge 3 to a foot 4, that is equipped with a skid-resistant rubber pad 5. The bottom section has a diameter that allows it to fit inside the center section 6 of the bar. The center section 6 is equipped with two opposing holes 7 at the bottom end thereof. The overall length of the bar can be adjusted by sliding the bottom section inside the center section and inserting a pin 8 through the two holes 7 in the center section and one pair of the holes 2 in the tubular bottom section.

The center section also has a number of opposing holes 9 at the top end to adjust the length by which the bar can be compressed, as explained below.

Figure 3:
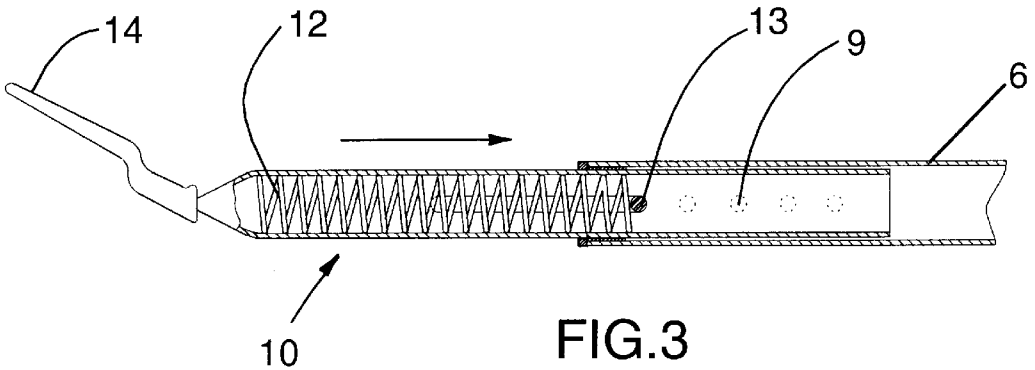
FIG. 3 is a cross-sectional side view of the upper end of the device.

The tubular top section 10 fits into the center section 6 and is equipped with two opposing slots 11 and a spring 12 that is installed inside this section (see FIG. 3). A bolt 13 is fastened through the topmost two holes of the center section and the slots in the top section. When the upper end of the slots in the top section contact this bolt, the bar is compressed to its shortest length. This bolt in effect provides the lock that prevents the door from being opened farther.

In the preferred embodiment of the invention, the slots are for example 4 inches long, which means that the bar can be adjusted to compress up to 4 inches. This means that the door can be opened up to approximately 8 inches, when the bar is positioned at an angle of 60 degrees to the floor.

Figure 4:
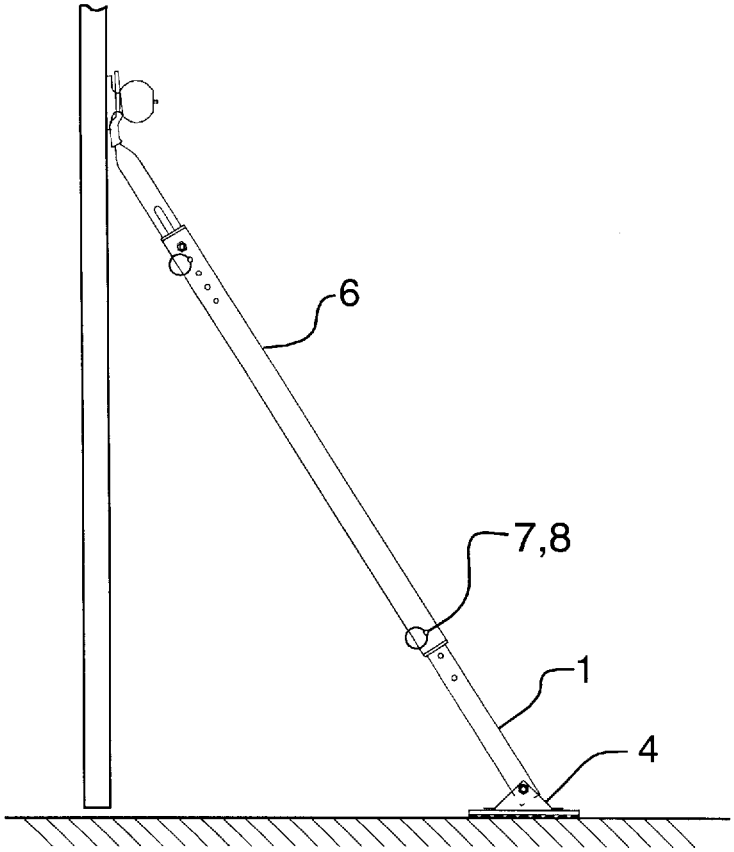
FIG. 4 is a side view showing the device installed against a door.
Figure 6:
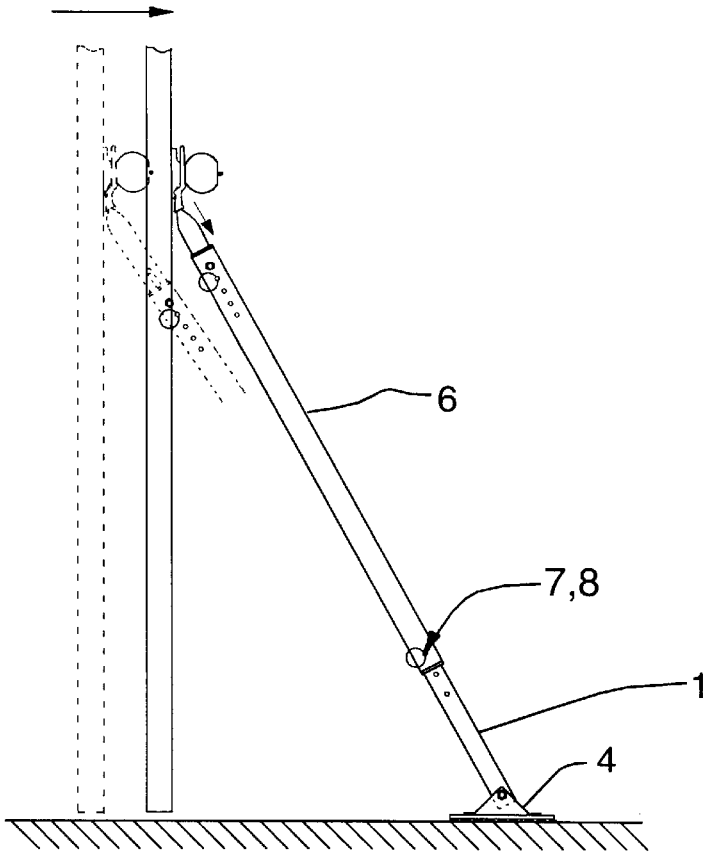
FIG. 6 is a side view showing the device installed against a door, with the door movement being shown.
Figure 8:
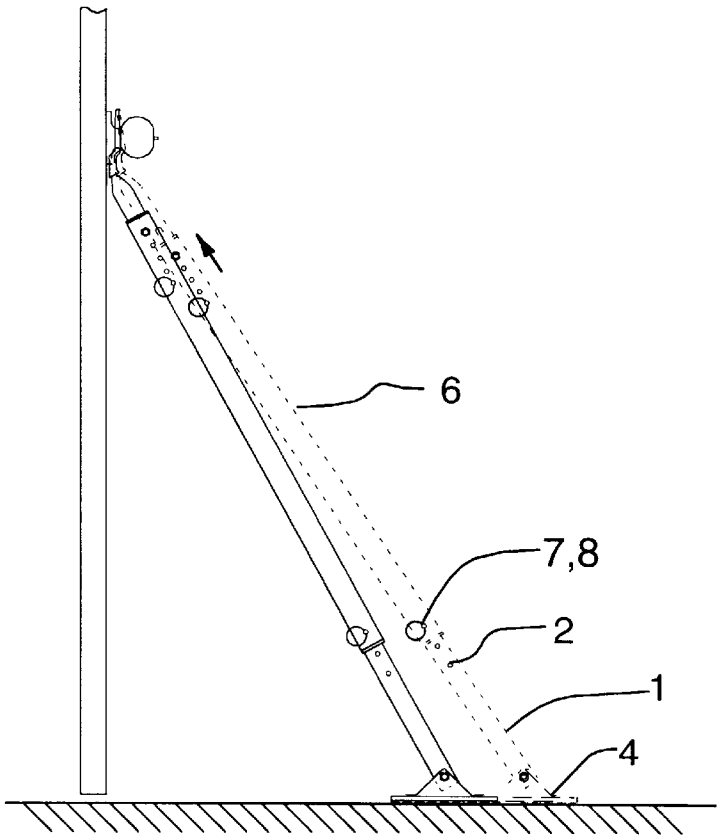
FIG. 8 is another side view of the device installed against a door, showing two positions on the floor.

The top section of the security bar is equipped with a generally Y-shaped end 14 that is curved to fit against the door under the knob of the door, as shown in FIGS. 4, 6 and 8.

By inserting a pin 15 through one of the pairs of holes 9 in the top end of the center section and through the slots of the top section, the length by which the top section can extend can be controlled. When the bar is extended until the bottom end of the slots contact the pin, the bar is extended to its longest length. It is now in the stand-by position with the door in the closed position (see FIG. 4).

Figure 5:
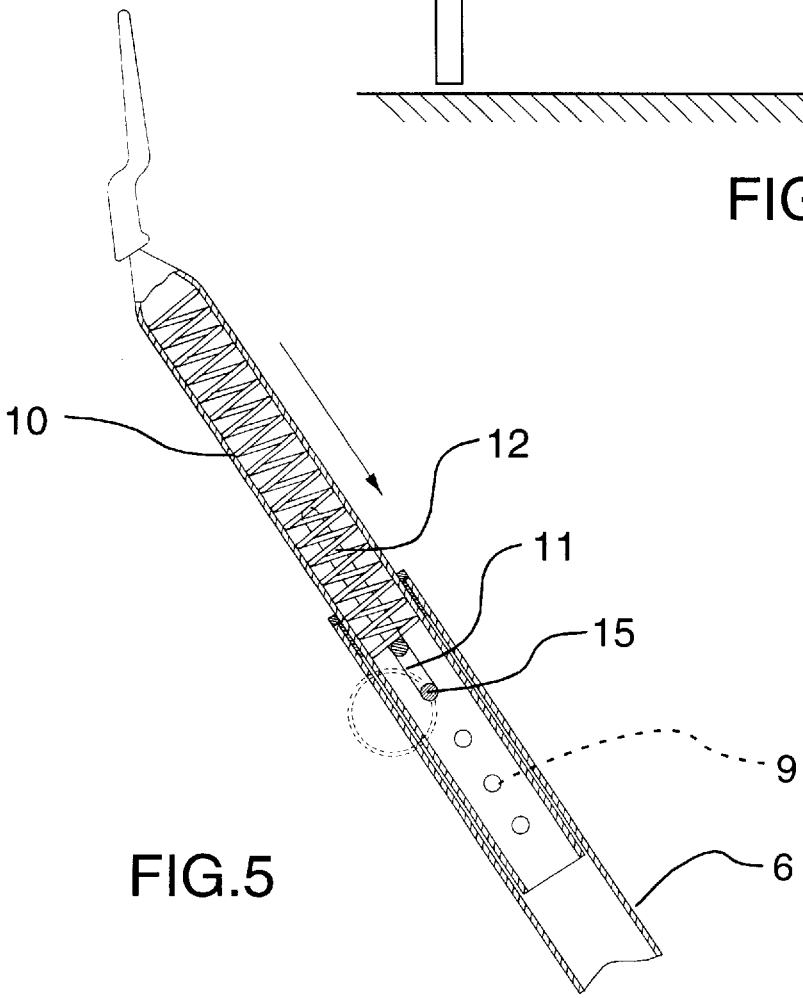
FIG. 5 is another cross-sectional side view of the upper end of the device.
Figure 7:
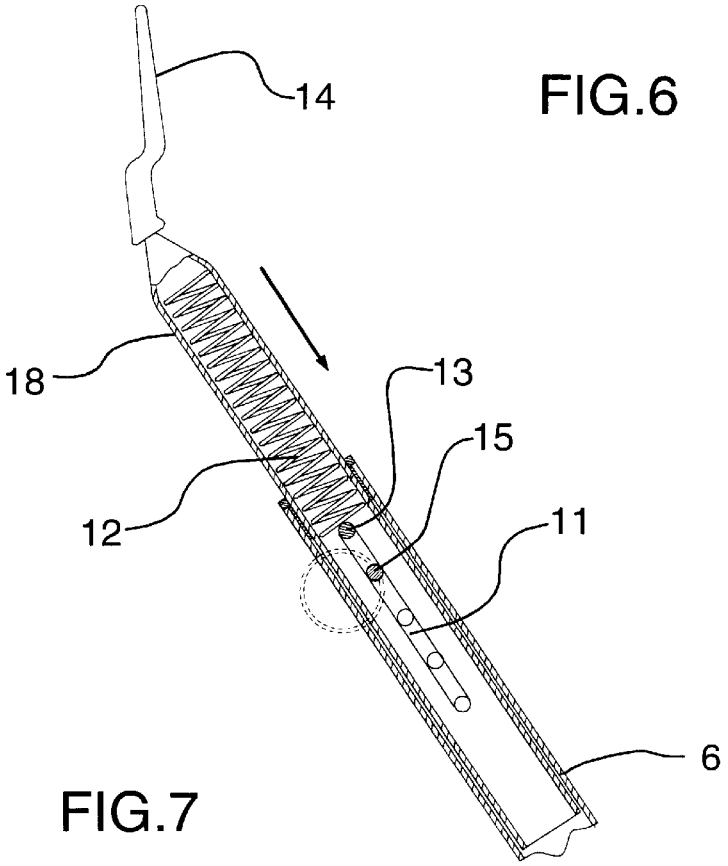
FIG. 7 is yet another cross-sectional side view of the upper end of the device.

FIGS. 5 and 7 show the bar with the pin placed in the hole nearest the bolt 13. FIG. 5 shows the bar fully extended with the pin 15 in contact with the lower end of the slots. This is the position of the bar in the stand-by mode when the door is closed (FIG. 4).

When the door is opened, the bar is compressed until the top end of the slots contact the bolt 13 (see FIG. 7). In this position the bar is compressed to the maximum distance and the door is opened the greatest distance (FIG. 6).

By placing the pin 15 in one of the other opposing holes in the top of the center section, the length with the spring in its extended position can be varied, thereby changing the distance of compression. This is an important feature of the preferred embodiment, because various doors have different thicknesses and may be recessed in the door frames by different distances. Therefore, although the desirable clear gap between the door and the door frame is always two to three inches, the amount of compression to obtain this clear gap will be different depending on the location and the installation.

Figure 9:
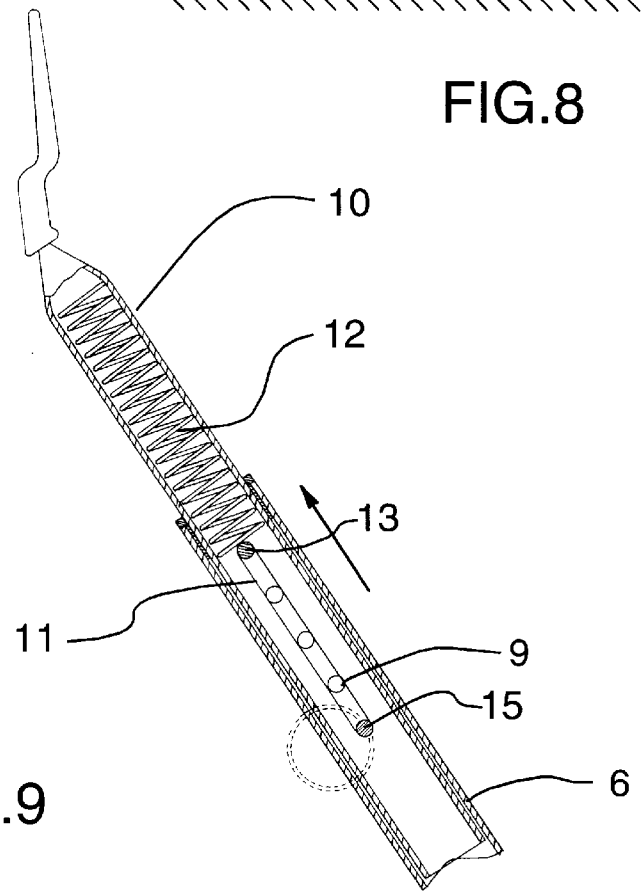
FIG. 9 is a final cross-sectional side view of the upper end of the device.

FIG. 9 shows the bar with the pin placed in the holes farthest away from the bolt 13. In this position the bolt 13 is in contact with one end of the slots and the pin is in contact with the other end of the slots. The bar thus cannot be compressed or extended at all. This position can be used at night, for example, when opening of the door is not required. The bar then acts as a solid brace similar to other bars that are on the market. The bar then has its shortest length and it is necessary to move the foot closer to the door to provide a good fit under the doorknob, as shown in FIG. 8.

In installing this security bar, the pin 15 is inserted in the holes that are farthest from the bolt 13, in effect locking the bar in the non-compressible position. The door is opened to the desired distance and the bar is then placed against a door at an angle of about 60 degrees to the horizontal with the Y-shaped end in contact with the underside of the doorknob. The pin 8 is now inserted through the holes in the bottom of the center section and one pair of the holes in the bottom section to secure the bottom section and fix the overall length of the bar. Without changing the position of the foot on the floor, the door is now closed, the pin 15 is removed, and the bar is allowed to extend until it contacts the lower side of the doorknob. The pin 15 is then inserted in the holes 9 that are the closest to the lower end of the slots, which determines the maximum distance that the bar can extend. Subsequent to this initial installation the bar can simply be placed under the door knob with the door in the closed position, and it is ready in the stand-by mode.

When the door is opened, the spring compresses (in effect making the bar shorter) and because the bar is positioned at approximately a 60 degree angle, the shortening of the bar by one inch allows the door to open approximately two inches (see FIG. 6).

In the initial installation adjustments, the user determines how far the door should open, which depends on how far the door is recessed within the door frame and on the owner's personal preference, and the pin 15 is inserted through the holes in the top of the center section and the slots in the top, as described above.

It should be clearly understood that there are a number of designs that can be used to accomplish the objectives of the invention. The above detailed description relates to the preferred embodiment, by way of example only. Many variations are possible within the scope of the invention, and will be apparent to those knowledgeable in the field. Such variations are considered to be within the scope of the invention.

For example, it should be understood that variations such as placing the slots in the outer, center section and the opposing holes in the inner, center section are obvious alternatives. Also, the top section can be made to be the "outer" tube and the center section can be the "inner" tube without at all changing the principle of the invention.

As another example, the spring loaded section could be located at the bottom instead of in the top section.

The bar could be fitted with a tapered end instead of the Y section 14, and this would then engage in a molded fitting that is fastened to the door. The advantage of such a variation is that the door knob would not be used as the support for the upper end of the bar. By fastening the molded fitting on the door at a specific distance from the floor, the overall length of the bar would not need to be adjustable and it would not be necessary to provide a separate bottom section 1 to provide for an adjustable overall length.

Another possible variation is that the ends of the bar could be fitted with ball joints or the like, to fit into special sockets in the door and/or the floor.

Many other variations are conceivable within the scope of the invention as defined by the following claims.

We claim as our invention:

1. A variable-length security bar comprising at least two sections, at least two of said sections being telescopically connected to each other, one of said telescopically connecting sections having opposing longitudinal slots, another of said telescopically connecting sections having two rod-like elements passing laterally through respective pairs of holes therethrough and through said slots, whereby said bar can telescope between a fully-extended position where one said rod-like element contacts one end of said slots, and a reduced-length position where the other said rod-like element contacts the other end of said slots, at least one of said rod-like elements being repositionable longitudinally relative to the other said rod-like element by being repositioned through another pair of holes, thereby providing a variable distance between said rod-like elements within said slots, whereby the distance between said fully-extended position and said reduced-length position can be varied, one end of said bar having means for engaging a floor adjacent a door, and the other end of said bar having means for engaging a door handle or other means on the door, said variable distance between said rod-like elements thereby enabling partial opening of said door if desired.

2. A variable-length security bar as recited in claim 1, comprising three sections, namely two said telescoping sections, and a third section telescopically connected to a lower one of the other two telescoping sections, securable thereto in any one of a number of discrete possible positions, whereby the overall maximum length of the bar can be varied.

3. A variable-length security bar as recited in claim 1, further comprising a spring positioned to bias said bar towards said fully-extended position.

4. A variable-length security bar as recited in claim 2, further comprising a spring positioned to bias said bar towards said fully-extended position.

5. A variable-length security bar as recited in claim 1, where one end of said bar has a generally Y-shaped end and the other end of the said bar has a pivoting foot pad with a skid-resistant lower surface.

6. A variable-length security bar as recited in claim 2, where one end of said bar has a generally Y-shaped end and the other end of the said bar has a pivoting foot pad with a skid-resistant lower surface.

7. A variable-length security bar as recited in claim 3, where one end of said bar has a generally Y-shaped end and the other end of the said bar has a pivoting foot pad with a skid-resistant lower surface.

8. A variable-length security bar as recited in claim 4, where one end of said bar has a generally Y-shaped end and the other end of the said bar has a pivoting foot pad with a skid-resistant lower surface.

9. A variable-length security bar as recited in claim 1, wherein said longitudinal slots have a length of at least four inches, and wherein said variable distance between said rod-like elements can be varied from zero to at least four inches apart.

10. A variable-length security bar as recited in claim 2, wherein said longitudinal slots have a length of at least four inches, and wherein said variable distance between said rod-like elements can be varied from zero to at least four inches apart.

11. A variable-length security bar as recited in claim 3, wherein said longitudinal slots have a length of at least four inches, and wherein said variable distance between said rod-like elements can be varied from zero to at least four inches apart.

12. A variable-length security bar as recited in claim 4, wherein said longitudinal slots have a length of at least four inches, and wherein said variable distance between said rod-like elements can be varied from zero to at least four inches apart.

13. A variable-length security bar as recited in claim 5, wherein said longitudinal slots have a length of at least four inches, and wherein said variable distance between said rod-like elements can be varied from zero to at least four inches apart.

14. A variable-length security bar as recited in claim 6, wherein said longitudinal slots have a length of at least four inches, and wherein said variable distance between said rod-like elements can be varied from zero to at least four inches apart.

15. A variable-length security bar as recited in claim 7, wherein said longitudinal slots have a length of at least four inches, and wherein said variable distance between said rod-like elements can be varied from zero to at least four inches apart.

16. A variable-length security bar as recited in claim 8, wherein said longitudinal slots have a length of at least four inches, and wherein said variable distance between said rod-like elements can be varied from zero to at least four inches apart.

* * * * *